US010451025B2

(12) United States Patent
MacArthur et al.

(10) Patent No.: US 10,451,025 B2
(45) Date of Patent: Oct. 22, 2019

(54) SYSTEMS AND METHODS FOR LEARNED DIESEL ENGINE START OPERATION

(71) Applicant: Toyota Motor Engineering & Manufacturing North America, Inc, Plano, TX (US)

(72) Inventors: Robert MacArthur, Ann Arbor, MI (US); Hayato Suzuki, Ann Arbor, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 78 days.

(21) Appl. No.: 15/885,479

(22) Filed: Jan. 31, 2018

(65) Prior Publication Data

US 2019/0234368 A1 Aug. 1, 2019

(51) Int. Cl.
*F02P 19/02* (2006.01)
*F02N 11/08* (2006.01)

(52) U.S. Cl.
CPC ..... *F02P 19/02* (2013.01); *F02N 11/0848* (2013.01); *F02N 2200/04* (2013.01); *F02N 2200/122* (2013.01)

(58) Field of Classification Search
CPC .. F02P 19/02; F02N 11/0848; F02N 2200/04; F02N 2200/122
USPC ..... 123/145 R, 145 A; 701/113; 73/114.62, 73/114.63
See application file for complete search history.

(56) References Cited

U.S. PATENT DOCUMENTS

| | | | | |
|---|---|---|---|---|
| 4,300,491 | A | 11/1981 | Hara | |
| 4,466,393 | A | 8/1984 | Bell | |
| 5,729,456 | A | 3/1998 | Boisvert | |
| 8,281,772 | B2 * | 10/2012 | Kurtz | B60W 10/06 123/145 A |
| 8,583,344 | B2 | 11/2013 | Cassani | |
| 9,683,536 | B2 | 6/2017 | Fulton | |
| 2008/0163840 | A1 | 7/2008 | Toedter | |
| 2014/0338626 | A1 | 11/2014 | Fulton | |
| 2014/0379242 | A1 * | 12/2014 | Henein | F02D 35/021 701/104 |

* cited by examiner

*Primary Examiner* — Hai H Huynh
(74) *Attorney, Agent, or Firm* — Sheppard, Mullin, Richter & Hampton LLP; Hector A. Agdeppa; Daniel N. Yannuzzi

(57) ABSTRACT

Systems and methods of optimizing cranking times of a diesel engine are provided. Factors such as cold weather, diesel fuel quality, and others may negatively impact cranking times of a diesel engine. Glow plugs used to heat combustion chambers of the diesel engine are controlled using pre-glow durations during which the glow plugs are pre-heated prior to cranking the diesel engine. Based on learned operating vehicle conditions or external conditions, the pre-glow durations can be adjusted to counteract the factors that have a negative impact on the cranking time of the diesel engine, and ultimately reduce cranking time of the diesel engine.

20 Claims, 7 Drawing Sheets

CALIBRATED TO 45CN

| AMBIENT OR COOLING WATER TEMP. (°C) | PRE-GLOW DURATION (SEC.) |
|---|---|
| 40 | 0 |
| 30 | 0 |
| 20 | 0 |
| 10 | 0.2 |
| 0 | 1 |
| -10 | 1.5 |
| -20 | 2 |
| -30 | 2.5 |
| -40 | 3 |

SYSTEMS AND METHODS FOR LEARNED DIESEL ENGINE START OPERATION

TECHNICAL FIELD

The disclosed technology relates generally to automotive systems, and more particularly, some embodiments relate to improving diesel engine start up through improved glow plug operation.

DESCRIPTION OF THE RELATED ART

A diesel engine is a form of internal combustion engine referred to as a compression-ignition engine. Combustion of atomized diesel fuel injected into a combustion chamber of a cylinder is caused by elevated temperature of the air in the combustion chamber due to mechanical compression. Compressing the air increases the air temperature to a degree where atomized diesel fuel injected into the combustion chamber spontaneously ignites. Accordingly, diesel engines do not require an additional heat source, such as a spark plug, to ignite the diesel fuel.

However, the combustion of diesel fuel can be hampered under certain conditions. For example, when the ambient temperature is cold, the mixture of air and diesel fuel can be difficult to ignite. To counteract this issue, glow plugs may be used (one per cylinder, for example) to aid in ignition. A glow plug is a heating element that can increase the temperature in a cylinder's combustion chamber prior to the diesel engine starting. Some glow plugs can reach up to 1,000° C. This ensures that the air/diesel fuel mixture will combust even when ambient temperatures are low. Glow plugs generally require a "pre-heating" or "pre-glow" period in order to bring the glow plug up to the desired temperature. When the weather is cold, glow plugs may need to be activated or energized for a longer pre-glow period or duration to reach that desired temperature. Moreover, glow plugs can degrade or deteriorate over time. That is, older glow plugs may take longer to heat up the air in a combustion chamber to a desired temperature. If such older glow plugs have not been pre-heated for enough time to reach a desired temperature, the result is a longer start time.

Other factors may also impact the time needed to get an engine to operate under its own power. For example, diesel fuel quality can be gauged in part by the speed at which the diesel fuel is able to combust. Diesel fuel quality can also be gauged by the amount of compression needed to achieve ignition. This diesel fuel quality is quantified in terms of a cetane number or CN (the inverse of octane rating for gasoline). Diesel fuels with a higher cetane number combust more quickly. Hence, the pre-glow period during which glow plugs are energized need not be as long, and less time is needed for a diesel engine to start when fueled with higher cetane number diesel fuel. On the other hand, lower quality diesel fuels are not as readily ignited and/or combusted. Hence, it may take longer for a diesel engine to start, necessitating longer pre-glow durations, when using such lower quality diesel fuels. Moreover, vehicles using lower quality diesel fuels may experience rough idling.

Brief Summary of Embodiments

In accordance with one embodiment, a computer-implemented method, comprises comparing an actual cranking time of a diesel engine to an expected range of cranking times. Upon a determination that the actual cranking time of the diesel engine is not within the expected range of cranking times a counter value is incremented. Upon the counter value meeting or exceeding a counter threshold, at least one pre-glow duration for controlling operation of at least one glow plug provided in a combustion chamber of the diesel engine is adjusted. The counter value can be reset, and operation of the at least one glow plug is controlled in accordance with the adjusted pre-glow duration.

In some embodiments, the actual cranking time of the diesel engine is determined during a start event. In some embodiments, the comparison of the actual cranking time of the diesel engine to the expected range of cranking times for subsequent start events is repeated. In some embodiments, the counter value is continually incremented in accordance with subsequent start events during which the actual cranking time of the diesel engine is not within the expected range of cranking times until the counter threshold is met or exceeded.

In some embodiments, the start event is defined by a key on state associated with starting the diesel engine and a state at which the diesel engine is self-operating.

In some embodiments, the expected range of cranking times includes an upper boundary comprising a maximum expected cranking time. In some embodiments, adjusting the at least one pre-glow duration comprises increasing the at least one pre-glow duration when the actual cranking time exceeds the maximum expected cranking time. The at least one pre-glow duration may be specified in a pre-glow map correlating a plurality of pre-glow durations to a plurality of corresponding ambient or water temperature values.

In some embodiments, the method further comprises adjusting each additional pre-glow duration specified in the pre-glow map.

In some embodiments, the expected range of cranking times includes a lower boundary comprising a minimum expected cranking time. In some embodiments, adjusting the at least one pre-glow duration comprises decreasing the at least one pre-glow duration when the actual cranking time is less than the minimum expected cranking time. The at least one pre-glow duration can be specified in a pre-glow map correlating a plurality of pre-glow durations to a plurality of corresponding ambient or water temperature values.

Moreover, the method may comprise adjusting each additional pre-glow duration specified in the pre-glow map.

In some embodiments, the expected range of cranking times is calibrated to a specified cetane number reflecting quality of diesel fuel used in the diesel engine.

In some embodiments, the at least one pre-glow duration specifies a duration of time during which the at least one glow plug is pre-heated prior to cranking of the diesel engine.

In some embodiments, a computer-implemented method for controlling startup of a vehicle powered by a diesel engine comprises comparing an actual cranking time of the diesel engine to at least one of a maximum expected cranking time and a minimum expected cranking time. Moreover, a current ambient or water temperature relative to the vehicle is compared to an ambient or water temperature associated with the at least one of the maximum expected cranking time and the minimum expected cranking time. Upon a determination that the actual cranking time of the diesel engine either exceeds the maximum expected cranking time or is less than the minimum expected cranking time, a counter value may be incremented. Upon the counter value meeting or exceeding a counter threshold, at least one pre-glow duration for controlling operation of at least one glow plug provided in a combustion chamber of the diesel engine is adjusted. The counter value can be reset, and operation of the at least one glow plug is controlled in accordance with the adjusted pre-glow duration.

In some embodiments, the actual cranking time of the diesel engine is determined during a start event.

In some embodiments, the start event is defined by a key on state associated with starting or attempting to start the diesel engine and a state at which the diesel engine is self-operating.

In some embodiments, the at least one pre-glow duration specifies a duration of time during which the at least one glow plug is pre-heated prior to cranking of the diesel engine.

In accordance with one embodiment, a system for controlling glow plug operation in a diesel engine of a vehicle comprises a timer measuring the time needed by the vehicle to go from a key on event to a self-operative state of the diesel engine. The system may further comprise a comparison circuit comparing the time needed by the vehicle to go from the key on event to a self-operative state of the diesel engine to an expected range of cranking times. Additionally, the system may comprise a counter incrementing a counter value upon a determination that the time needed by the vehicle to go from the key on event to a self-operative state of the diesel engine is not within the expected range of cranking times. Further still, the system may comprise a processing unit adjusting a pre-glow duration for controlling operation of at least one glow plug provided in a combustion chamber of the diesel engine upon the counter value meeting or exceeding a counter threshold. The processing unit resets the counter value, and during a subsequent key on event, controls the flow of power to the at least one glow plug for a period of time commensurate with the adjusted pre-glow duration.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1A:
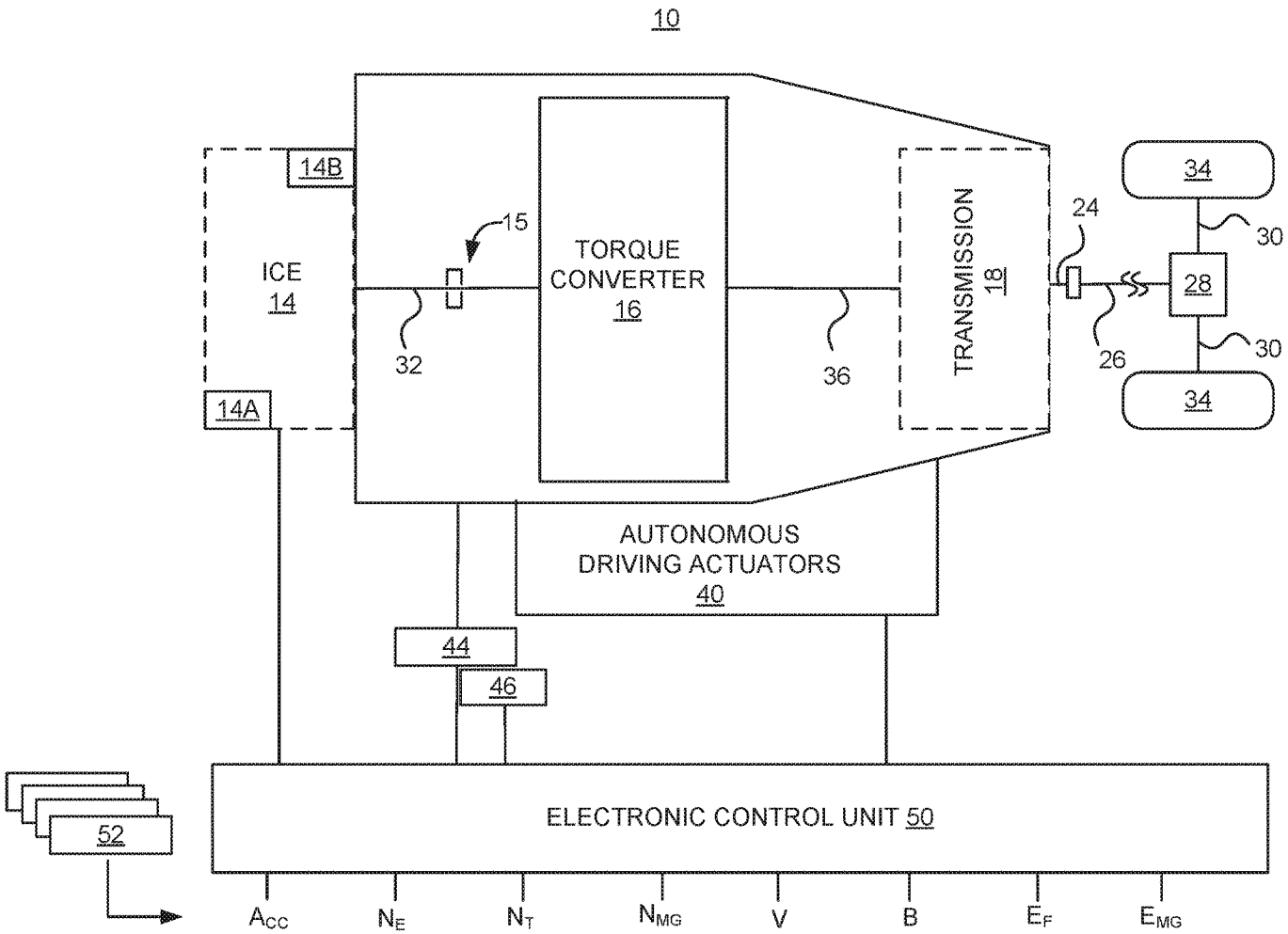
FIG. 1A illustrates an example of a vehicle with which systems and methods for learned diesel engine start operation can be implemented in accordance with one embodiment of the present disclosure.

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION OF THE EMBODIMENTS

Embodiments of the technology disclosed herein are directed to improving, e.g., reducing, the cranking time needed to get a diesel engine to operate under its own power by adjusting glow plug operation. Cranking time can be defined as the time between a "key on" event and a point at which a diesel engine can operate under its own power (described below). Glow plug operation in accordance with various embodiments is controlled using a counter-based system and method of determining a pre-glow period or duration during which a glow plug should be energized in order to bring the glow plug up to temperature prior to cranking the diesel engine.

The counter-based system and method disclosed herein may use a pre-glow map or matrix correlating one or more parameters impacting glow plug operation to a specified pre-glow duration. Based on current operating conditions, e.g., a current ambient or water temperature, actual cranking time of a diesel engine can be compared to an expected cranking time. If enough instances arise where the actual cranking time exceeds the expected cranking time, the pre-glow duration specified in the pre-glow map can be increased. In this way, any degradation of performance due to, e.g., cold weather, glow plug deterioration, lower fuel quality, etc., can be counteracted by adjusting pre-glow durations under all (or some) operating conditions. Likewise, if enough occurrences arise where the actual cranking time falls below the expected cranking time enough times, the pre-glow duration specified in the pre-glow map can be decreased. This can prolong the life of a glow plug, for example, by reducing wear and tear.

In some embodiments, a glow plug control circuit may be used to control operation of one or more glow plugs used in a diesel engine. The glow plug control circuit may access a pre-glow map from memory to determine a pre-glow duration during which a glow plug(s) is to be energized. Comparisons between actual and expected cranking times of the diesel engine measured using, e.g., a timer, can be made. A counter can be used to determine how many times, if any, the actual cranking time exceeds (or falls below) an expected cranking time. If the number of occurrences when the actual cranking time exceeds (or falls below) the expected cranking time surpasses a threshold value, the glow plug control circuit can adjust (up or down) the pre-glow duration by some incremental value, i.e., time. Prior to starting the diesel engine, the glow plug control circuit can access the pre-glow map (adjusted or otherwise), and transfer current from a power storage device, e.g., battery, via an electronic relay to the glow plug(s). The current is transferred to the glow plug(s) for a determined amount of time specified as the pre-glow duration in the pre-glow map.

It should be noted that the terms "optimize," "optimal" and the like as used herein can be used to mean making or achieving performance as effective or perfect as possible. Moreover, techniques disclosed herein can refer to, e.g., performing calculations, etc. that result in "more accurate"

determinations. However, as one of ordinary skill in the art reading this document will recognize, perfection cannot always be achieved. Accordingly, these terms can also encompass making or achieving performance as good or effective as possible or practical under the given circumstances, or making or achieving performance better than that which can be achieved with other settings or parameters.

An example vehicle in which glow plug control according to various embodiments may be implemented is illustrated in FIG. 1A. FIG. 1A illustrates a drive system of a vehicle 10 that may include an internal combustion engine (ICE) 14 as a source of motive power. Driving force generated by ICE 14 can be transmitted to one or more wheels 34 via a torque converter 16, a transmission 18, a differential gear device 28, and a pair of axles 30. In particular, vehicle 10 relies on the motive force generated at ICE 14, and a clutch 15 may be included to engage ICE 14.

ICE 14 can be an internal combustion engine such as a diesel or similarly powered engine in which fuel is injected into and combusted in a combustion chamber. An output control circuit 14A may be provided to control drive (output torque) of ICE 14. Output control circuit 14A may output a target engine torque used to control switching of an electronic throttle valve through the use of a throttle actuator an to control fuel injection. Output control circuit 14A may also include an ignition device that controls ignition timing, and the like. Output control circuit 14A may execute output control of ICE 14 according to a command control signal(s) supplied from an electronic control unit 50, described below. Such output control can include, for example, throttle control, fuel injection control, and ignition timing control. In the case of a diesel engine, a starter/cranking motor 14B may be used to rotate (crank) ICE 14 in order to initiate ICE 14's operation under its own power. Starters may be electric, pneumatic, or hydraulic. In some cases, a starter may be another ICE.

Power storage device 44 may also be used to power electrical or electronic systems in the vehicle, such as for example starter 14B. Power storage device 44 can include, for example, one or more batteries, capacitive storage units, or other storage reservoirs suitable for storing electrical energy that can be used to power the aforementioned electrical or electronic systems. When power storage device 44 is implemented using one or more batteries, the batteries can include, for example, nickel metal hydride batteries, lithium ion batteries, lead acid batteries, nickel cadmium batteries, lithium ion polymer batteries, and other types of batteries. A state of charge (SOC) sensor 46 may determine a current SOC of power storage device 44.

A torque converter 16 can be included to control the application of power from ICE 14 to transmission 18. Torque converter 16 can include a viscous fluid coupling that transfers rotational power from the motive power source to the driveshaft via the transmission. Torque converter 16 can include a conventional torque converter or a lockup torque converter. In other embodiments, a mechanical clutch can be used in place of torque converter 16.

Clutch 15 can be included to engage and disengage ICE 14 from the drivetrain of the vehicle. In the illustrated example, a crankshaft 32, which is an output member of ICE 14, may be selectively coupled to torque converter 16 via clutch 15. Clutch 15 can be implemented as, for example, a multiple disc type hydraulic frictional engagement device whose engagement is controlled by an actuator such as a hydraulic actuator. Clutch 15 may be controlled such that its engagement state is complete engagement, slip engagement, and complete disengagement, depending on the pressure applied to the clutch. For example, a torque capacity of clutch 15 may be controlled according to the hydraulic pressure supplied from a hydraulic control circuit (not illustrated). When clutch 15 is engaged, power transmission is provided in the power transmission path between the crankshaft 32 and torque converter 16. On the other hand, when clutch 15 is disengaged, motive power from engine 14 is not delivered to the torque converter 16. In a slip engagement state, clutch 15 is engaged, and motive power is provided to torque converter 16 according to a torque capacity (transmission torque) of the clutch 15.

An electronic control unit 50 may be included, and may control the electric drive components of vehicle 10, as well as other vehicle components. Electronic control unit 50 may include circuitry to control various aspects of vehicle operation. Electronic control unit 50 may include, for example, a microcomputer that includes one or more processing units (e.g., microprocessors), memory storage (e.g., RAM, ROM, etc.), and I/O devices. The processing units of electronic control unit 50, execute instructions stored in memory to control one or more electrical systems or subsystems in the vehicle. Electronic control unit 50 can include a plurality of electronic control units such as, for example, an electronic engine control module, a powertrain control module, a transmission control module, a suspension control module, a body control module, and so on. As a further example, electronic control units can be included to control systems and functions such as doors and door locking, lighting, human-machine interfaces, cruise control, telematics, braking systems (e.g., ABS or ESC), battery management systems, and so on. In some embodiments, the processing units of electronic control unit 50 control operation of glow plugs by energizing the glow plugs for a determined amount of time (pre-glow duration). These various control units can be implemented using two or more separate electronic control units, or using a single electronic control unit.

In the example illustrated in FIG. 1A, electronic control unit 50 receives information from a plurality of sensors included in vehicle 10. For example, electronic control unit 50 may receive signals that indicate vehicle operating conditions or characteristics, or signals that can be used to derive vehicle operating conditions or characteristics. These may include, but are not limited to accelerator operation amount, $A_{CC}$, a revolution speed, $N_E$, of ICE 14 (engine RPM), and vehicle speed, $N_V$. These may also include torque converter 16 output, $N_T$, brake operation amount/pressure, B, SOC (i.e., the charged amount for power storage device 44 detected by SOC sensor 46). Accordingly, vehicle 10 can include a plurality of sensors 52 that can be used to detect various conditions internal or external to the vehicle and provide sensed conditions to engine control unit 50 (which, again, may be implemented as one or a plurality of individual control circuits). In one embodiment, sensors 52 may be included to detect one or more conditions directly or indirectly such as, for example, fuel efficiency, $E_F$, motor efficiency, etc.

In some embodiments, one or more of sensors 52 may include their own processing capability to compute the results for additional information that can be provided to electronic control unit 50. In other embodiments, one or more sensors may be data-gathering-only sensors that provide raw data to electronic control unit 50. In further embodiments, hybrid sensors may be included that provide a combination of raw data and processed data to electronic control unit 50. Sensors 52 may provide an analog output or a digital output.

Sensors 52 may be included to detect not only vehicle conditions but also to detect external conditions as well. Sensors that might be used to detect external conditions can include, for example, sonar, radar, lidar or other vehicle proximity or collision sensors, and cameras or other image sensors. Image sensors can be used to detect, for example, traffic signs indicating a current speed limit, road curvature, obstacles, and so on. Still other sensors may include those that can detect road grade. While some sensors can be used to actively detect passive environmental objects, other sensors can be included and used to detect active objects such as those objects used to implement smart roadways that may actively transmit and/or receive data or other information.

Figure 1B:
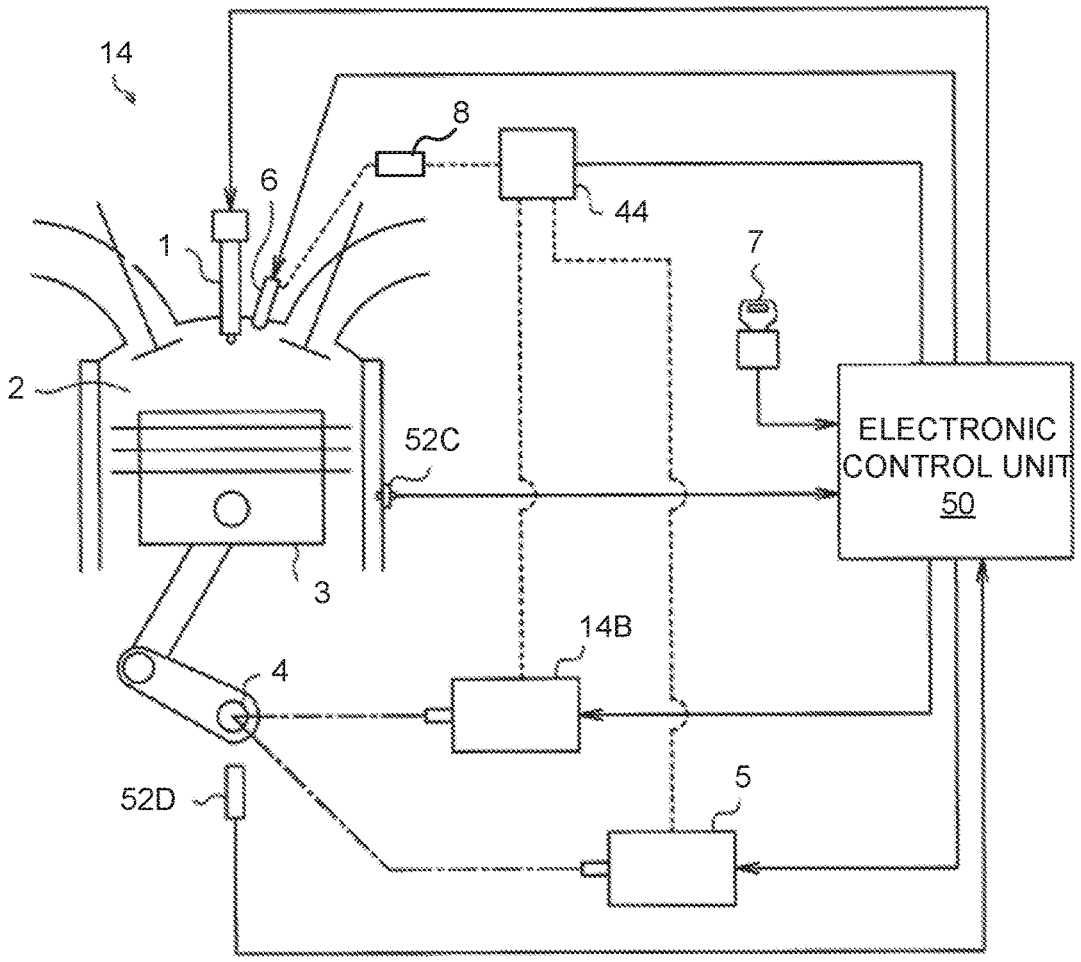
FIG. 1B illustrates an example diesel engine operative in the vehicle of FIG. 1A.

FIG. 1B illustrates example details and elements associated with glow plug operation in a diesel engine of a vehicle, e.g., vehicle 10 of FIG. 1A. In an engine, e.g., ICE 14 of FIG. 1A, fuel is injected from an injector 1 into a combustion chamber 2 to be combusted. This causes a piston 3 to reciprocate so that a crankshaft 4 rotates. A starter, e.g., starter 14B of FIG. 1A, and an alternator 5 are connected to the crankshaft 4. Starter 14B forcibly rotates (cranks) the crankshaft 4 upon ICE 14 being started. Alternator 5 is driven by the rotation of crankshaft 4 to generate power for charging a battery, e.g., one embodiment of power storage device 44.

When ICE 14 is started, starter 14B is driven using power supplied by power storage device 44 to crank ICE 14. During cranking, i.e., the time between a key on state and when ICE 14 is able to operate on its own, fuel is injected into combustion chamber 2 thereby starting operation of ICE 14. A glow plug 6 is provided in combustion chamber 2 of ICE 14 to improve ignition performance and the combustion characteristics of fuel in combustion chamber 2 during a period from the start of ICE 14 to a state where ICE 14 can operate on its own (referred to as the glow period). Glow plug 6 produces heat when energized by power supplied from power storage device 44 via relay 8 (or other current switching device or element). As previously described, glow plug 6 may be energized prior to starting ICE 14/activating starter engine 14B for some period of time (pre-glow duration) in order to heat up glow plug 6. During this pre-glow period, glow plug 6 is brought up to temperature so that when ICE 14 is started, the cranking time of ICE 14 is reduced.

Alternator 5 includes a voltage regulator to regulate the power output and duty-controls the voltage regulator based on a duty command value to generate power output corresponding to a duty command value. The duty command value is set as a variable to keep power storage device 44 at an appropriate SOC. In particular, the duty command value is increased as the voltage of power storage device 44 decreases. Thus, the power output of alternator 5 is small when glow plug 6 is de-energized, and the power output of alternator 5 is large when glow plug 6 is energized.

In addition to the above-noted functions, electronic control unit 50 may also control operation of starter 14B, operation of glow plug 6, power output from alternator 5, and operation of ignition switch 7. Additional ones of sensors 52 may include a water temperature sensor 52C for detecting the temperature of cooling water for ICE 14, and an engine RPM sensor 52D for detecting rotational speed of ICE 14.

Ignition switch 7 can be actuated by an operator of vehicle 10 to, e.g., one of either four positions including "off," "accessories," "on," and "start," so that a signal corresponding to one of these four positions can be output. Drive circuits for injector 1, starter 14B, glow plug 6, and alternator 5 are connected to output ports of electronic control unit 50.

In operation, ignition switch 7 can be switched from the "off" position to the "accessories" positions, and then to the "on" position (the aforementioned key on state). In response, various electronic equipment in vehicle 10, such as glow plug 6, are energized. Energizing glow plugs, e.g., glow plug 6 prior to starting ICE 14 is an example of a pre-glow period. When ignition switch 7 is switched from the "on" position to the "start" position, starter 14B powered by power storage device 44 is driven to start cranking ICE 14. During this cranking period, glow plug 6 remains energized (after being pre-heated during the pre-glow period), and fuel injected by injector 1 into combustion chamber 2 causes ICE 14 to start. After ICE 14 begins operating in a self-supporting manner, the ignition switch 7 power to starter engine 14B can be shut off, and power to glow plug 6 can also be shut off. It should be understood that in vehicles having a different starting mechanism, e.g., a push button start mechanism, a key on state would be analogous to pushing a start button without depressing a brake actuator. To attempt to start a vehicle using a push button start mechanism, a start state would be analogous to pushing the start button while depressing the brake actuator to activate starter 14B.

For example, if ignition switch 7 of vehicle 10 is a keyed ignition switch, vehicle 10 may be put into an accessories on position. The operator of vehicle 10 can wait for glow plug 6 to light and pre-heat. For example, a glow plug light indicator (not shown) can be lit when the glow plug 6 is receiving current. Once the glow plug light indicator shuts off, the operator may attempt to crank ICE 14. It should be noted however that the operator can try to crank ICE 14 at any point in time. If ignition switch 7 of vehicle 10 is a push button-type ignition switch, the operator may put vehicle 10 in accessories on mode by pushing the start button, but without actuating the brake pedal. The pre-heat/pre-glow process may be performed. The operator can actually start the car (by pushing the start button while depressing the brake pedal). Alternatively, the operator can try to start vehicle 10 without switching to the accessories on mode (by actuating the brake pedal at the first actuation/press of the start button). In this case, vehicle 10 will automatically go into the accessories on mode, wait for pre-heat/pre-glow process to complete, after which ICE 14 can be started.

Figure 1C:
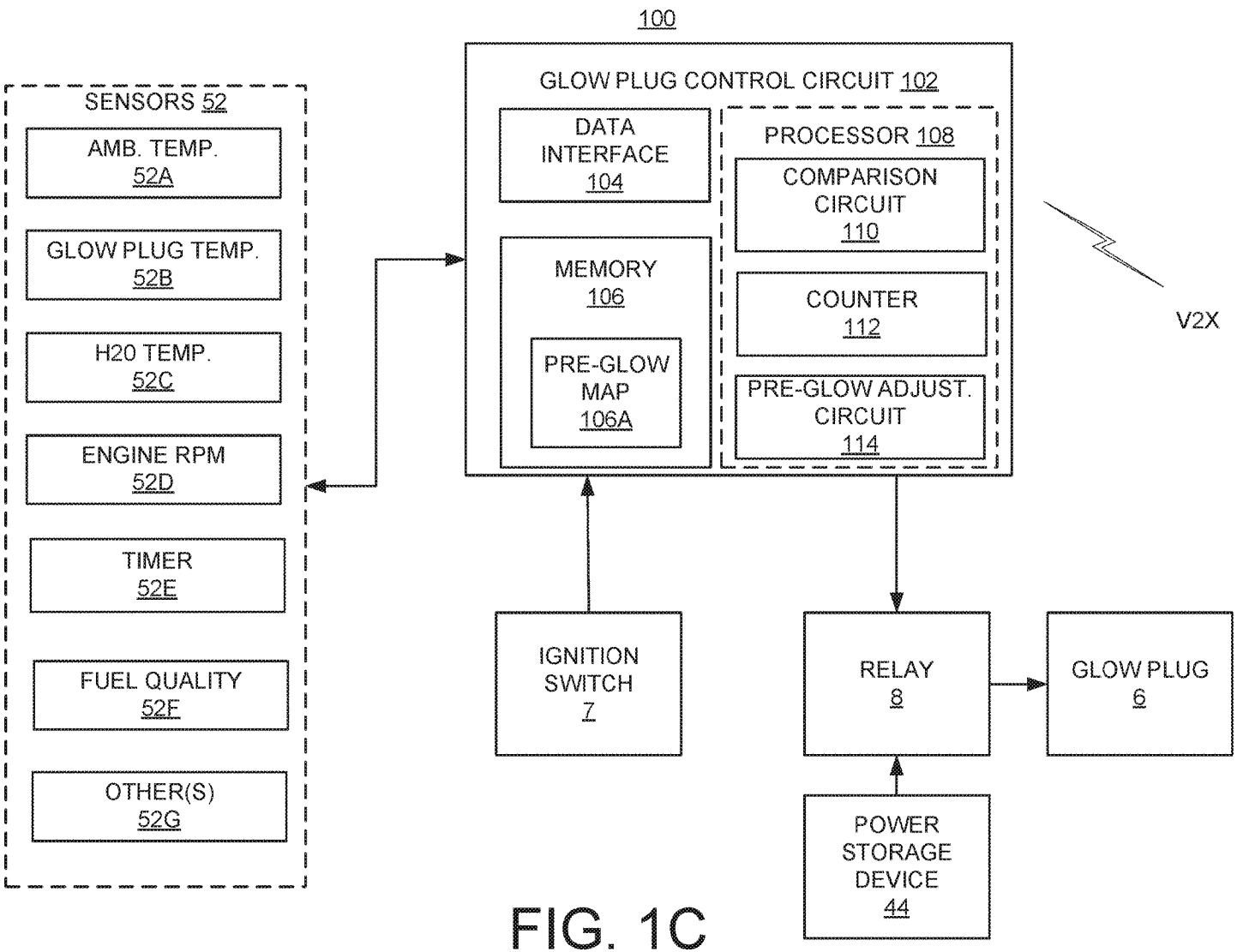
FIG. 1C illustrates an example architecture for implementing learned diesel engine start operation in the vehicle of FIG. 1A.

FIG. 1C illustrates an example of a glow plug control system 100 in accordance with one embodiment of the present disclosure. In this example, system 100 may include a glow plug control circuit 102, a plurality of sensors 52A-G, ignition switch 7, relay 8, power storage device 44, and one or more glow plugs 6. Sensors 52A-G and glow plug control circuit 102 can communicate via a wired or wireless communication interface. Glow plug circuit 102 may also communicate with one or more of ignition switch 7 and relay 8 via wired or wireless communications. Glow plug control circuit 102 can be implemented as a standalone electronic control unit or as part of an electronic control unit such as, for example electronic control unit 50.

A data interface 104 can be used for communications between glow plug control circuit 102 and sensors 52A-G, and between glow plug control circuit 102 and ignition switch 7 and relay 8. Data interface 104 can be either a wireless communications/processing interface or a wired communications/processing interface with an associated hardwired data port (not illustrated). A wireless data interface can include a transmitter and a receiver (not shown) to allow wireless communications via any of a number of communication protocols. Communication protocols can include for example, WiFi, Bluetooth, near field communications (NFC), Zigbee, and any of a number of other wireless communication protocols whether standardized, proprietary, open, point-to-point, networked or otherwise.

When embodied in wired form, data interface 104 can include a transmitter and a receiver (not shown) for hardwired communications with other devices, e.g., a hardwired interface to other components, including sensors 52A-G, ignition switch 7, and relay 8. A wired data interface can communicate with other devices using Ethernet or any of a number of other wired communication protocols whether standardized, proprietary, open, point-to-point, networked or otherwise.

A memory 106 can be used to store various information or data used in or by glow plug control circuit 102. Memory 106 may include one or more various forms of memory or data storage (e.g., flash, RAM, etc.) that may be used to store parameters, instructions, and/or variables for processor 108, as well as any other suitable information. In some embodiments, memory 106 may be used to store a pre-glow map 106A that correlates, e.g., ambient or water temperatures with suggested pre-glow durations.

Although the example of FIG. 1C is illustrated using processor and memory circuitry, as described below with reference to circuits disclosed herein, comparison circuit 110, counter 112, and pre-glow adjust circuit 114 can be implemented utilizing any form of circuitry. For example, this circuitry can be hardware, software, or a combination thereof. By way of further example, one or more processors, controllers, ASICs, PLAs, PALs, CPLDs, FPGAs, logical components, software routines or other mechanisms might be implemented to make up glow plug control circuit 102 or its components.

Referring back to data interface 104, data interface 104 can be used to receive data from one or more sensors 52A-G. The data received from one or more sensors 52A-G may indicate current operating conditions of vehicle 10 or external conditions that can be used to determine the correct glow plug duration during which glow plug 6 is energized prior to cranking ICE 14. For example, ambient or water temperature may be measured, and information regarding the ambient or water temperature may be sent to glow plug control circuit 102 by way of data interface 104. Data interface 104 may also be used to receive information regarding a state of operation or status condition of one or more vehicle components. For example, glow plug control circuit 102 may monitor the condition of ignition switch 7, e.g., whether it is in a key on state, to determine when a timer, e.g., timer 52F, should begin recording cranking time of ICE 14. Upon determining a pre-glow duration during which glow plug 6 should be energized, glow plug control circuit 102 may send one or more signals instructing relay 8 to allow current from power storage device 44 to pass through to glow plug 6.

Sensors 52A-G may be example embodiments of sensors 52 illustrated in FIG. 1A. Sensors 52A-G can include one or more of the above-mentioned sensors and/or sensors capable of sensing the above-mentioned data that may be vehicle operating conditions and/or external conditions inputs.

For example, as already noted above, pre-glow map 106A may correlate ambient temperature to a specified pre-glow duration. Accordingly, ambient temperature sensor 52A may determine the ambient temperature relative to vehicle 10. Using this ambient temperature data, glow plug control circuit 102 may access pre-glow map 106A to find a pre-glow duration corresponding to the measured ambient temperature that should be used when energizing glow plug 6 prior to cranking ICE 14. Ambient temperature sensor 52A may be a mechanical thermometer, and electrical thermistor, or other device capable of determining the ambient temperature. It should be noted that in some embodiments, external information sources may be used as alternatives to one or more of sensors 52A0G. For example, instead of using ambient temperature sensor 52A, glow plug control circuit 102 may communicate with external information providers or sources, such as roadside infrastructure, broadcast information providers, other vehicles to obtain ambient temperature data. To communicate with such external information providers or sources, data interface 104 may communicate using vehicle-to-infrastructure (V2I) or vehicle-to-vehicle (V2V), together referred to as V2X communication channels.

Glow plug temperature sensor 52B may be another temperature sensor that is used to sense the temperature of glow plug 6. Still another temperature sensor that may be used in vehicle 10 is a water temperature sensor 52C. Water temperature sensor 52C detects the temperature of cooling water for ICE 14. The glow period of glow plug 6 can be determined based on the temperature of cooling water. For example, glow plug 6 may be de-energized if the temperature of the cooling water is higher than a determined threshold. It should be understood that although embodiments described herein are disclosed in the context of cooling water temperature, if another fluid or cooling liquid is utilized, the relevant temperature would be of that fluid/cooling liquid.

Sensors 52 may also include an engine RPM sensor 52D. In some embodiments, the cranking time associated with ICE 14 may be monitored and measured as a function of engine speed. As noted above, various embodiments are directed to reducing the cranking time of a diesel engine, e.g., ICE 14 of vehicle 10. Cranking time can be defined as the time needed for ICE 14 to operate under its own power beginning with a key on state. That is, cranking time can be measured from the time ignition switch 7 goes to a key on state, until ICE 14 achieves a certain rotational speed, i.e., reaches a certain RPM. Accordingly, engine RPM sensor 52D may begin measuring the rate of rotation of crankshaft 4 (FIG. 1B) of ICE 14 upon ignition switch 7 being put into a key on state. Engine RPM sensor 52D may monitor that rate of rotation until it reaches a value commensurate with ICE 14 being operable under its own power, i.e., without the assistance of starter 14B. It should be understood that the engine RPM indicative of a diesel engine being operable under its own power can vary depending on one or more characteristics of the diesel engine, e.g., balance, moment of inertia, mass, etc.

In conjunction with determining engine speed/RPM with engine RPM sensor 52D, the cranking time can be measured by a timer 52E. That is, timer 52E may begin timing upon ignition switch being put into a key on state, and continue timing until a threshold engine speed is met. Accordingly, timer 52E may communicate with engine RPM sensor 52D, e.g., engine RPM sensor 52D may send a stop trigger or notification signal to 52E upon sensing that ICE 14 has reached the requisite engine speed. In other embodiments, engine RPM sensor 52D may continuously update glow plug control circuit 102 with engine speed data. Upon glow plug control circuit 102 determining that that requisite engine speed has been reached for ICE 14 (memory 106 may further store this requisite engine speed data), glow plug control circuit 102, through data interface 104, can transmit a stop command to timer 52E. The time between when timer 52E began timing and when timer 52E stops timing is indicative of the (actual) cranking time of ICE 14.

In some embodiments, a fuel quality sensor 52E may be used to determine the quality of diesel fuel being used in ICE 14. Fuel quality sensor 52E may be any one of a number of fuel quality sensors. In one embodiment, fuel quality sensor 52E may be an embedded device that uses MicroOptoElectroMechanical Sensing (MOEMS) to determine fuel composition by measuring light transmission in the infrared spectrum. Fuel characteristics including cetane number can be determined using such a sensor. In some embodiments, a determination of the cetane number of the diesel fuel being used in an engine, e.g., ICE 14, can be used to calibrate pre-glow map 106A. As described above, pre-glow map 106A may correlate ambient or water temperature to pre-glow duration. In some examples, pre-glow map 106A is calibrated to a particular cetane number value, e.g., 45CN, a midrange cetane number, in which case, fuel quality sensor 52E may not be needed. As noted above, in some embodiments, water temperature of the water used to cool ICE 14 may be used as a relevant factor in determining pre-glow duration. For example, by using ambient or water temperature, glow plugs may be operated regardless of ICE temperature. However, when basing glow plug operation on water temperature, a warm ICE (e.g., after some period of operation), glow plug operation may not be needed due to the ICE already being warm. Use of water temperature or ambient temperature as a basis for glow plug operation may be a determination made by a vehicle manufacturer. In some embodiments, below a particular ambient temperature threshold (e.g., in extremely cold environments), ambient temperature may be used so that glow plug operation is enabled more often to ensure proper heating of the cylinders.

However, in other examples, memory 106 may store multiple pre-glow maps, each of which are calibrated to a specific cetane number. In this way, specific fuel quality can be considered, further refining the pre-glow duration to ambient or water temperature relationship. That is, every time vehicle 10 is fueled with diesel fuel, fuel quality sensor 52E determines the cetane number of the diesel fuel. Fuel quality sensor 52E may relay this fuel quality information to glow plug control circuit 102, which may then select or access the appropriate pre-glow map corresponding to that fuel quality information.

Processor 108 of glow plug control circuit 102 may include a comparison circuit 110, a counter 112, and a pre-glow adjust circuit 114. As previously noted, glow plug control circuit 102 may energize one or more glow plugs during a pre-glow period in order to pre-heat the one or more glow plugs. That is, upon ignition switch 7 being put into a key on state, glow plug control circuit 102 may request or obtain from ambient temperature sensor 52A, current ambient temperature information. Depending on the current ambient temperature sensed by ambient temperature sensor 52A or water temperature sensor 52C, glow plug control circuit 102 may select a corresponding pre-glow duration from pre-glow map 106A specifying a time period for which glow plug 6 is to be pre-heated prior to cranking ICE 14.

Figures 2A, 2B:
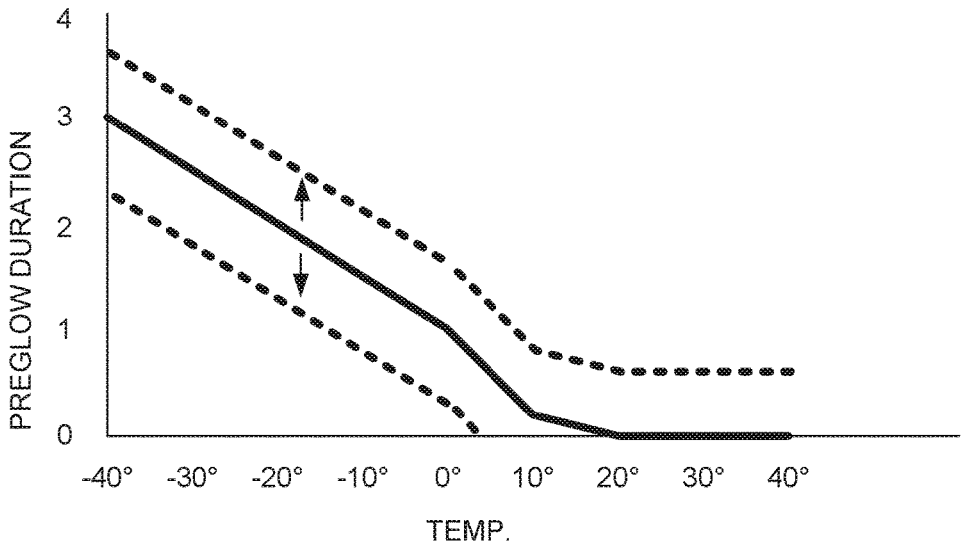
FIG. 2A is an example pre-glow map used in accordance with one embodiment of the present disclosure.
FIG. 2B is an example graph illustrating pre-glow duration adjustment of the pre-glow map of FIG. 2A.

FIG. 2A illustrates an example pre-glow map, which is illustrated as a table or matrix correlating ambient or cooling water temperature to pre-glow durations. In the example of FIG. 2A, the specified relationships between ambient or cooling water temperature and pre-glow duration are calibrated to a particular cetane number, in this example, 45CN. In some embodiments, additional pre-glow maps may be calibrated to different fuel qualities and stored in glow plug control circuit 102 (FIG. 1C). It should be understood that the specified relationships can vary, for example, instead of singular values for ambient temperature, ranges of temperatures may be associated with pre-glow durations.

Returning to FIG. 1C, comparison circuit 110 may include a cache or have coded therein, expected cranking times associated with ICE 14 for particular ambient or water temperatures. Expected cranking times can be determined based on, e.g., statistical analysis of optimal and/or preferred cranking times regarding particular types of ICEs, models of ICEs, etc. For example, ICE 14 may be a particular model having a particular number of cylinders, a certain mass, balance point, and moment of inertia. Based on testing regarding similar ICEs, a vehicle manufacturer may determine that at a particular ambient or water temperature, maximum and minimum expected cranking time relates to acceptable diesel engine starting performance. It should be understood that minimum expected cranking time is one way to account for decreasing the amount of time taken to pre-heat/pre-glow the glow plugs, thereby extending the life of glow plugs and/or other electrical components associated with this process. Accordingly, each time ICE 14 is started or an operator attempts to start ICE 14, comparison circuit 110 compares the actual cranking time of ICE 14 (received or obtained from timer 52E described above) to the aforementioned expected maximum/minimum cranking times.

Comparison circuit 110 determines whether the actual cranking time of ICE 14 exceeds the expected maximum cranking time or falls below the expected minimum cranking time. That is, a range of cranking times is specified by the maximum expected cranking time as an upper limit, and the minimum expected cranking time as a lower limit. If comparison circuit 110 determines that the actual cranking time of ICE 14 measured by timer 52E either exceeds the maximum expected cranking time or falls below the minimum expected cranking time, counter 112 increments its current count. Counter 112 may be an electronic counter, such as a register-type circuit, flip-flip circuit, etc. Various types of counters or circuits adapted to increment a count based on some occurrence (in this case exceeding or falling below the maximum or minimum expected cranking time, respectively) may be used.

The purpose of counter 112 is to account for anomalous events related to starting events. That is, vehicle 10 may be started under cold conditions potentially suggesting a need to adjust pre-glow duration of glow plug 6. However, this event may be a singular event, e.g., vehicle 10 may have been driven into an area with cold weather, but only temporarily. Adjusting the pre-glow duration of glow plug 6 after only a single event where the actual cranking time of ICE 14 exceeds the maximum expected cranking time may be premature. That is, if vehicle 10 is driven to an area with warmer weather, there may not be a need to adjust the pre-glow duration. As another example vehicle 10 may be fueled with a diesel fuel having a low cetane number, which can result in the actual cranking time exceeding the maximum expected cranking time. However, adjusting the pre-glow duration of glow plug 6 would again be premature if vehicle 10 were to be refueled with diesel fuel having a higher cetane number.

Accordingly, some determined number of counts or events where the maximum expected cranking time is exceeded or the minimum expected cranking time is not met may be specified to rule out potentially anomalous events. For example, a vehicle manufacturer or operator may set a counter threshold to be, e.g., five occurrences of the actual cranking time exceeding the maximum expected cranking time. In this way, counter 112 increments its count each time ICE 14 is started or an attempt to start ICE 14 is made, and the actual cranking time exceeds the maximum expected cranking time or falls below the minimum expected cranking time. Once counter 112 has counted up to the counter threshold, the pre-glow duration of glow plug 6 can be adjusted accordingly. It should be noted that counter 112 may comprise two sets of counters, one for determining a count reflecting when the actual cranking time exceeds the maximum expected cranking time. Another counter may be used to determine a count reflecting when the actual cranking time falls below the minimum expected cranking time.

Pre-glow adjustment circuit 114 can be set to adjust the pre-glow duration of glow plug 6 up or down depending on whether the maximum expected cranking time has been exceeded or actual cranking time falls below the minimum expected cranking time. That is, pre-glow adjustment circuit 114 can access pre-glow map 106A and update it with adjusted pre-glow durations. Pre-glow adjustment circuit 114 may adjust the pre-glow duration by using a positive or negative multiplier/adding or subtracting an adjustment value. Referring to FIGS. 2A and 2B, for example, pre-glow adjustment circuit 114 may add to each specified pre-glow duration time, such as 0.5, 0.8, 2, 3, or some other value. For example, if the actual cranking time falls below the minimum expected cranking time enough times, pre-glow adjustment circuit 114 can subtract 0.5 from each pre-glow duration value. Thus, at an ambient or water temperature of 0°, the pre-glow duration for glow plug 6 can be reduced to 0.5 sec instead of 1 sec. It should be understood that the multiplier or added/subtracted value may be chosen beforehand, e.g., by a vehicle manufacturer.

FIG. 2B illustrates how an adjustment by pre-glow adjustment circuit 114 can shift pre-glow durations up or down depending on the circumstances. It should be noted that in the above-described embodiment, pre-glow adjustment circuit 114 adjusts the pre-glow duration across all temperatures. That is, certain factors or conditions such as the fuel quality can impact cranking time regardless of temperature. That is, use of a lower quality diesel fuel can lengthen actual cranking time enough times that adjusting the pre-glow duration so that glow plug 6 is energized for a longer pre-heat/pre-glow period is desirable regardless of temperature. However, in some embodiments, adjustment of the pre-glow duration may be selectively applied, e.g., for only certain temperatures. That is, pre-glow adjustment circuit 114 may only adjust pre-glow duration specified in pre-glow map 106A for a particular temperature or temperature range corresponding to the current ambient temperature or water temperature.

After updating pre-glow map 106A, counter 112 may be reset. That is, after making an adjustment to pre-glow map 106A, any additional, potential adjustments are made relative to the last adjustment. Once pre-glow map 106A has been adjusted, and a subsequent start event occurs, glow plug control circuit 102 may access pre-glow map 106A and energize glow plug 6 according to the updated pre-glow duration in order to pre-heat glow plug 6. Hence, glow plug control circuit 102 can transmit a signal or instruction to relay 8 instructing relay 8 to allow power/current to pass from power storage device 44 to glow plug 6.

As previously discussed, glow plugs are heating elements provided in a combustion chamber to aid in heating the air temperature in the combustion chamber. Depending on the vehicle, and for example, the number of cylinders a diesel engine may have, the number of glow plugs used in a vehicle can vary. For example, a vehicle with a four cylinder diesel engine may have four glow plugs (one glow plug per cylinder). A vehicle with a six cylinder diesel engine may have six glow plugs (one glow plug per cylinder). Accordingly, it should be understood that although only one glow plug 6 is illustrated for ease of reference, multiple glow plugs can be provided in a vehicle. Moreover, in some embodiments, glow plug control circuit 102 may control multiple glow plugs in unison, whereas in some embodiments, glow plug control circuit 102 may control different subsets of glow plugs using different parameters. For example, different pre-glow durations may be applied to different glow plugs or sets of glow plugs depending on, e.g., the temperature within each cylinder associated with a particular glow plug. For example, different glow plugs may age/deteriorate at different rates, and thus, different pre-glow durations can be applied to different glow plugs. Likewise, although only one relay 8 is illustrated in FIG. 1C, it should be understood that in some embodiments, multiple relays can be used. That is, each of a plurality of glow plugs may be associated with its own relay for allowing power to transfer from power storage device 44 to each of the plurality of glow plugs. In other embodiments, e.g., when glow plug control circuit 102 controls multiple glow plugs in unison, a single relay may be used to transfer power to all the glow plugs.

Figure 3A:
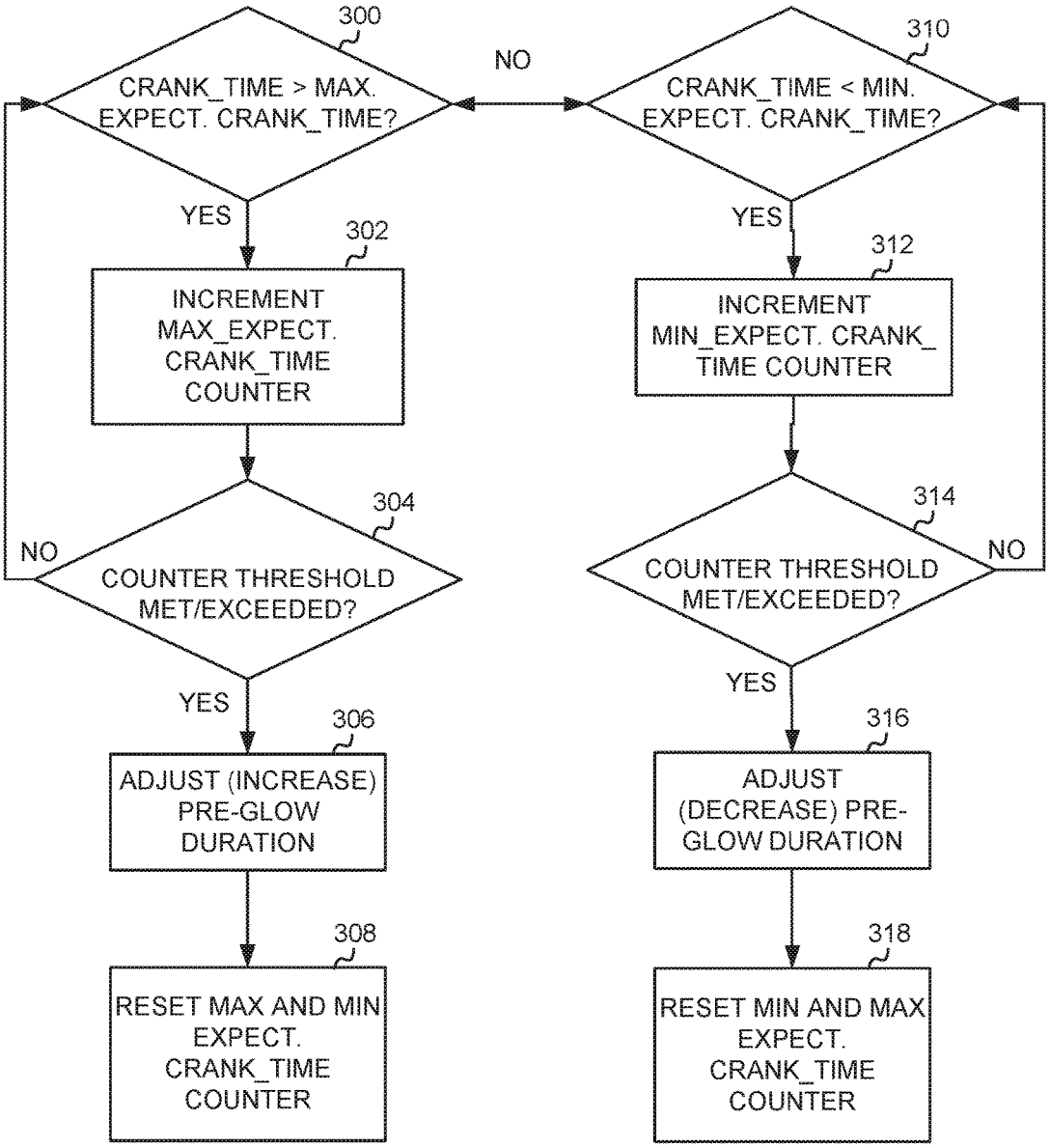
FIG. 3A is a flow chart of example operations that can be performed to implement learned diesel engine start operation in accordance with one embodiment.

FIG. 3A is a flow chart illustrating example operations that can be performed to adjust pre-glow durations of glow plugs in accordance with one embodiment. At operation 300, a check is performed to determine if an actual cranking time is greater than a maximum expected cranking time. If the actual cranking time exceeds the maximum expected cranking time, e.g., if the weather is cold enough or the quality of the diesel fuel is low enough to impact diesel fuel ignition, etc., the maximum expected crank time counter is incremented at operation 302.

As described previously, a counter threshold can be determined to be some number of occurrences when the actual cranking time exceeds the maximum expected cranking time. Accordingly, a check can be performed at operation 304 to determine if the number of occurrences meets or exceeds this counter threshold. If the counter threshold has been met/exceeded, the pre-glow duration specified in the pre-glow map (e.g., pre-glow map 106A of FIG. 1C) can be adjusted by increasing the pre-glow duration at operation 306. At operation 308, the counter is reset.

If, at operation 300, it is determined that the actual cranking time does not exceed the maximum expected cranking time, a check can be performed to determine if the actual cranking time does not meet the minimum expected cranking time at operation 310. For example, moving from an area where lower quality diesel fuel is sold to an area where higher quality diesel fuel is sold may result in decreased cranking times due to the ability of higher cetane number diesel fuels igniting/combusting more easily. If the actual cranking time is less than a minimum expected cranking time, a counter is incremented at operation 312. At operation 314, a check is performed to determine if a counter threshold (i.e., threshold number of occurrences) has been met/exceeded. Once the counter threshold has been met/exceeded, pre-glow duration is adjusted, i.e., decreased, at operation 316. Subsequently, at operation 318, the counter can be reset. It should be understood that all counters can be reset, i.e., those associated with the minimum and maximum expected cranking time.

Figure 3B:
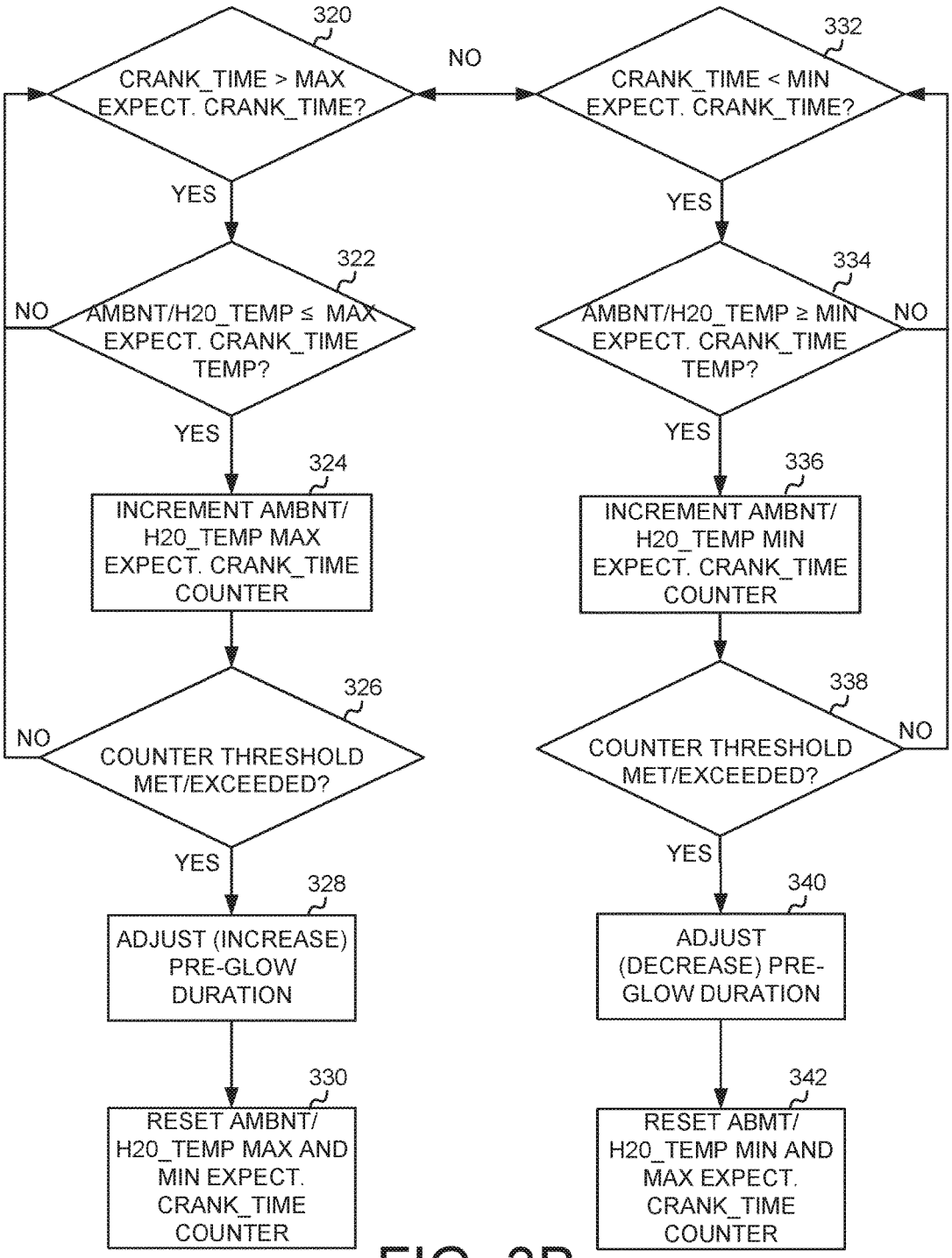
FIG. 3B is a flow chart of example operations that can be performed to implement learned diesel engine start operation in accordance with one embodiment.

As noted above, in some embodiments, other factors or conditions may be taken into account so that pre-glow adjustment may be more selectively applied. FIG. 3B illustrates example operations that can be performed to control glow plug operation in accordance with another embodiment.

FIG. 3B is a flow chart illustrating example operations that can be performed to adjust pre-glow durations of glow plugs in accordance with one embodiment. At operation 320, a check is performed to determine if an actual cranking time is greater than a maximum expected cranking time. At operation 322, a check is performed to determine if the current ambient or water temperature is less than or equal to the ambient temperature associated with the maximum expected cranking time. If the actual cranking time exceeds the maximum expected cranking time, and the current ambient or water temperature is less than or equal to the ambient or water temperature associated with the maximum expected cranking time, a counter for that specific ambient or water temperature is incremented at operation 324.

As described previously, a counter threshold can be determined to be some number of occurrences when the actual cranking time exceeds the maximum expected cranking time. Accordingly, a check can be performed at operation 326 to determine if the number of occurrences meets/exceeds this counter threshold. If the counter threshold has been met/exceeded, the pre-glow duration specified in the pre-glow map (e.g., pre-glow map 106A of FIG. 1C) can be adjusted by increasing the pre-glow duration at operation 328. For example, a multiplier/added value can be applied to increase pre-glow duration. In this embodiment, adjustment of the pre-glow map is applied only to those pre-glow duration values associated with the current ambient or water temperature and below. At operation 330, the counter specific to that ambient or water temperature is reset.

If, at operation 320, it is determined that the actual cranking time does not exceed the maximum expected cranking time, a check can be performed to determine if the actual cranking time does not meet the minimum expected cranking time at operation 332. Again, moving from an area where lower quality diesel fuel is used to an area where higher quality diesel fuel is used may result in decreased cranking times. At operation 334, a check is performed to determine if the current ambient or water temperature is greater than or equal to the ambient or water temperature associated with the minimum expected cranking time. If the actual cranking time is less than a minimum expected cranking time, and the current ambient or water temperature is greater than or equal to the ambient or water temperature associated with the minimum expected cranking time, a counter for that ambient or water temperature is incremented at operation 336. At operation 338, a check is performed to determine if a counter threshold (i.e., threshold number of occurrences) has been met/exceeded. Once the counter threshold has been met/exceeded, pre-glow duration is adjusted, i.e., decreased, at operation 340. Subsequently, at operation 342, the counter specific to that ambient or water temperature can be reset. It should be understood that all counters can be reset, i.e., those associated with the minimum and maximum expected cranking time.

Figure 4:
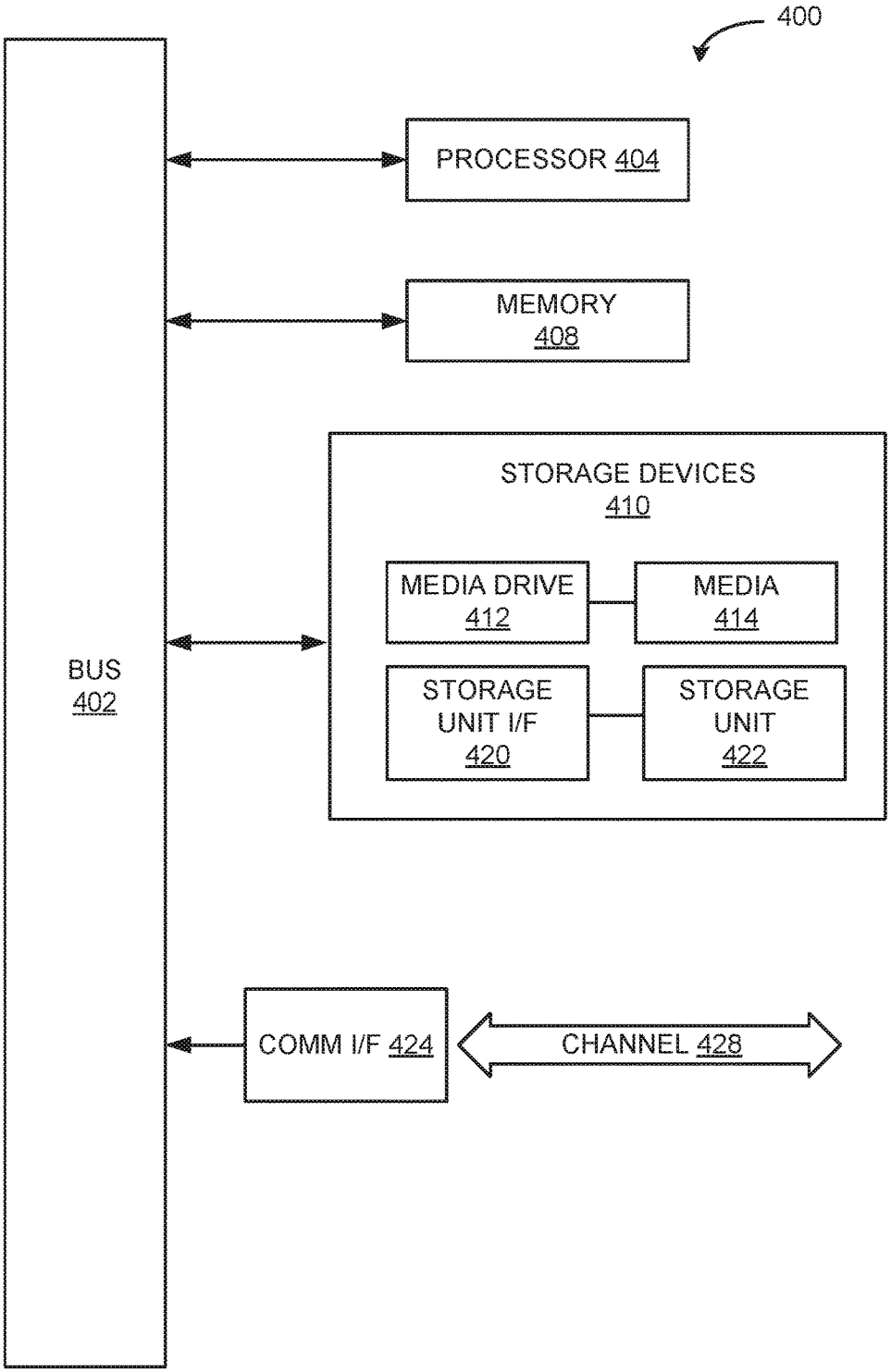
FIG. 4 illustrates an example computing system that may be used in implementing various features of embodiments of the disclosed technology.

As used herein, a circuit (or component) might be implemented utilizing any form of hardware, software, or a combination thereof. For example, one or more processors, controllers, ASICs, PLAs, PALs, CPLDs, FPGAs, logical elements, software routines or other mechanisms might be implemented to make up a circuit. In implementation, the various circuits described herein might be implemented as discrete circuits or the functions and features described can be shared in part or in total among one or more circuits. In other words, as would be apparent to one of ordinary skill in the art after reading this description, the various features and functionality described herein may be implemented in any given application and can be implemented in one or more separate or shared circuits in various combinations and permutations. Even though various features or elements of functionality may be individually described or claimed as separate circuits, one of ordinary skill in the art will understand that these features and functionality can be shared among one or more common circuits, and such description shall not require or imply that separate circuits are required to implement such features or functionality.

Where circuits are implemented in whole or in part using software, in one embodiment, these software elements can be implemented to operate with a computing or processing system capable of carrying out the functionality described with respect thereto. One such example computing system is shown in FIG. 4. Various embodiments are described in terms of this example-computing system 400. After reading this description, it will become apparent to a person skilled in the relevant art how to implement the technology using other computing systems or architectures.

Referring now to FIG. 4, computing system 400 may represent, for example, computing or processing capabilities found within desktop, laptop and notebook computers; hand-held computing devices (PDA's, smart phones, cell phones, palmtops, etc.); mainframes, supercomputers, workstations or servers; or any other type of special-purpose or general-purpose computing devices as may be desirable or appropriate for a given application or environment. Computing system 400 might also represent computing capabilities embedded within or otherwise available to a given device. For example, a computing system might be found in other electronic devices such as, for example, digital cameras, navigation systems, cellular telephones, portable computing devices, modems, routers, WAPs, terminals and other electronic devices that might include some form of processing capability.

Computing system 400 might include, for example, one or more processors, controllers, control modules, or other processing devices, such as a processor 404. Processor 404 might be implemented using a general-purpose or special-purpose processing engine such as, for example, a microprocessor (whether single-, dual- or multi-core processor), signal processor, graphics processor (e.g., GPU) controller, or other control logic. In the illustrated example, processor 404 is connected to a bus 402, although any communication medium can be used to facilitate interaction with other components of computing system 400 or to communicate externally.

Computing system 400 might also include one or more memory modules, simply referred to herein as main memory 408. For example, in some embodiments random access memory (RAM) or other dynamic memory, might be used for storing information and instructions to be executed by processor 404. Main memory 408 might also be used for storing temporary variables or other intermediate information during execution of instructions to be executed by processor 404. Computing system 400 might likewise include a read only memory ("ROM") or other static storage device coupled to bus 402 for storing static information and instructions for processor 404.

The computing system 400 might also include one or more various forms of information storage mechanism 410, which might include, for example, a media drive 412 and a storage unit interface 420. The media drive 412 might include a drive or other mechanism to support fixed or removable storage media 414. For example, a hard disk drive, a floppy disk drive, a magnetic tape drive, an optical disk drive, a CD or DVD drive (R or RW), a flash drive, or other removable or fixed media drive might be provided. Accordingly, storage media 414 might include, for example, a hard disk, a floppy disk, magnetic tape, cartridge, optical disk, a CD or DVD, or other fixed or removable medium that is read by, written to or accessed by media drive 412. As these examples illustrate, the storage media 414 can include a computer usable storage medium having stored therein computer software or data.

In alternative embodiments, information storage mechanism 410 might include other similar instrumentalities for allowing computer programs or other instructions or data to be loaded into computing system 400. Such instrumentalities might include, for example, a fixed or removable storage unit 422 and an interface 420. Examples of such storage units 422 and interfaces 420 can include a program cartridge and cartridge interface, a removable memory (for example, a flash memory or other removable memory module) and memory slot, a flash drive and associated slot (for example, a USB drive), a PCMCIA slot and card, and other fixed or removable storage units 422 and interfaces 420 that allow software and data to be transferred from the storage unit 422 to computing system 400.

Computing system 400 might also include a communications interface 424. Communications interface 424 might be used to allow software and data to be transferred between computing system 400 and external devices. Examples of communications interface 424 might include a modem or softmodem, a network interface (such as an Ethernet, network interface card, WiMedia, IEEE 802.XX, Bluetooth® or other interface), a communications port (such as for example, a USB port, IR port, RS232 port, or other port), or other communications interface. Software and data transferred via communications interface 424 might typically be carried on signals, which can be electronic, electromagnetic (which includes optical) or other signals capable of being exchanged by a given communications interface 424. These signals might be provided to communications interface 424 via a channel 428. This channel 428 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 408, storage unit 420, media 414, and channel 428. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing system 400 to perform features or functions of the disclosed technology as discussed herein.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A computer-implemented method, comprising:

comparing an actual cranking time of a diesel engine to an expected range of cranking times;

upon a determination that the actual cranking time of the diesel engine is not within the expected range of cranking times, incrementing a counter value;

upon the counter value meeting or exceeding a counter threshold, adjusting at least one pre-glow duration for controlling operation of at least one glow plug provided in a combustion chamber of the diesel engine;

resetting the counter value; and controlling operation of the at least one glow plug in accordance with the adjusted pre-glow duration.

2. The computer-implemented method of claim 1, wherein the actual cranking time of the diesel engine is determined during a start event.

3. The computer-implemented method of claim 2, further comprising repeating the comparison of the actual cranking time of the diesel engine to the expected range of cranking times for subsequent start events.

4. The computer-implemented method of claim 3, further comprising continually incrementing the counter value in accordance with subsequent start events during which the actual cranking time of the diesel engine is not within the expected range of cranking times until the counter threshold is met or exceeded.

5. The computer-implemented method of claim 2, wherein the start event is defined by a key on state associated with starting the diesel engine and a state at which the diesel engine is self-operating.

6. The computer-implemented method of claim 1, wherein the expected range of cranking times includes an upper boundary comprising a maximum expected cranking time.

7. The computer-implemented method of claim 6, wherein adjusting the at least one pre-glow duration comprises increasing the at least one pre-glow duration when the actual cranking time exceeds the maximum expected cranking time.

8. The computer-implemented method of claim 7, wherein the at least one pre-glow duration is specified in a pre-glow map correlating a plurality of pre-glow durations to a plurality of corresponding ambient or water temperature values.

9. The computer-implemented method of claim 8, further comprising adjusting each additional pre-glow duration specified in the pre-glow map.

10. The computer-implemented method of claim 1, wherein the expected range of cranking times includes a lower boundary comprising a minimum expected cranking time.

11. The computer-implemented method of claim 10, wherein adjusting the at least one pre-glow duration comprises decreasing the at least one pre-glow duration when the actual cranking time is less than the minimum expected cranking time.

12. The computer-implemented method of claim 11, wherein the at least one pre-glow duration is specified in a pre-glow map correlating a plurality of pre-glow durations to a plurality of corresponding ambient or water temperature values.

13. The computer-implemented method of claim 12, further comprising adjusting each additional pre-glow duration specified in the pre-glow map.

14. The computer-implemented method of claim 1, wherein the expected range of cranking times is calibrated to a specified cetane number reflecting quality of diesel fuel used in the diesel engine.

15. The computer-implemented method of claim 1, where the at least one pre-glow duration specifies a duration of time during which the at least one glow plug is pre-heated prior to cranking of the diesel engine.

16. The computer-implemented method of claim 15, wherein the at least one pre-glow duration specifies a duration of time during which the at least one glow plug is pre-heated prior to cranking of the diesel engine.

17. A computer-implemented method for controlling startup of a vehicle powered by a diesel engine, comprising:

comparing an actual cranking time of the diesel engine to at least one of a maximum expected cranking time and a minimum expected cranking time;

comparing a current ambient or water temperature relative to the vehicle to an ambient or water temperature associated with the at least one of the maximum expected cranking time and the minimum expected cranking time;

upon a determination that the actual cranking time of the diesel engine either exceeds the maximum expected cranking time or is less than the minimum expected cranking time, incrementing a counter value;

upon the counter value meeting or exceeding a counter threshold, adjusting at least one pre-glow duration for controlling operation of at least one glow plug provided in a combustion chamber of the diesel engine;

resetting the counter value; and controlling operation of the at least one glow plug in accordance with the adjusted pre-glow duration.

18. The computer-implemented method of claim 17, wherein the actual cranking time of the diesel engine is determined during a start event.

19. The computer-implemented method of claim 18, wherein the start event is defined by a key on state associated with starting or attempting to start the diesel engine and a state at which the diesel engine is self-operating.

20. A system for controlling glow plug operation in a diesel engine of a vehicle, comprising:

a timer measuring the time needed by the vehicle to go from a key on event to a self-operative state of the diesel engine;

a comparison circuit comparing the time needed by the vehicle to go from the key on event to a self-operative state of the diesel engine to an expected range of cranking times;

a counter incrementing a counter value upon a determination that the time needed by the vehicle to go from the key on event to a self-operative state of the diesel engine is not within the expected range of cranking times;

a processing unit adjusting a pre-glow duration for controlling operation of at least one glow plug provided in a combustion chamber of the diesel engine upon the counter value meeting or exceeding a counter threshold, wherein the processing unit resets the counter value, and during a subsequent key on event, controls the flow of power to the at least one glow plug for a period of time commensurate with the adjusted pre-glow duration.

* * * * *